United States Patent [19]

Hasegawa et al.

[11] Patent Number: 4,885,188

[45] Date of Patent: Dec. 5, 1989

[54] PROCESS FOR FORMING THIN FILM OF METAL SULFIDES

[75] Inventors: Yo Hasegawa, Nara; Kazuyuki Okano, Katano; Akira Nakanishi; Hiroshi Hatase, both of Hirakata, all of Japan

[73] Assignee: Matsushita Electric Industrial Co., Ltd., Osaka, Japan

[21] Appl. No.: 910,215

[22] PCT Filed: Jan. 16, 1986

[86] PCT No.: PCT/JP86/00015

§ 371 Date: Aug. 29, 1986

§ 102(e) Date: Aug. 29, 1986

[87] PCT Pub. No.: WO86/04362

PCT Pub. Date: Jul. 31, 1986

[30] Foreign Application Priority Data

Jan. 17, 1985 [JP] Japan ..... 60-6417
Jan. 17, 1985 [JP] Japan ..... 60-6441
Jan. 17, 1985 [JP] Japan ..... 60-6444

[51] Int. Cl.[4] ..... B05D 5/12

[52] U.S. Cl. ..... 427/126.1; 427/108; 427/126.2; 427/226; 427/343; 427/377

[58] Field of Search ..... 427/377, 226, 108, 343, 427/126.1, 126.2

[56] References Cited

U.S. PATENT DOCUMENTS

| | | | |
|---|---|---|---|
| 2,905,574 | 9/1959 | Spengler et al. | 427/226 |
| 3,148,084 | 9/1964 | Hill et al. | 427/64 |
| 3,887,383 | 6/1975 | Nesteruk | 427/25 |
| 4,310,182 | 4/1985 | Cornils et al. | 427/226 |
| 4,332,879 | 6/1982 | Pastor et al. | 427/226 |
| 4,418,099 | 11/1983 | Cuevas et al. | 427/226 |
| 4,492,721 | 1/1985 | Joosten et al. | 427/226 |
| 4,530,742 | 7/1985 | Carlin et al. | 427/226 |

FOREIGN PATENT DOCUMENTS

| | | | |
|---|---|---|---|
| 1297777 | 5/1961 | France | 427/126.1 |
| 1009539 | 11/1965 | United Kingdom . | |
| 2049636A | 12/1980 | United Kingdom . | |

*Primary Examiner*—Janyce Bell

*Attorney, Agent, or Firm*—Stevens, Davis, Miller & Mosher

[57] ABSTRACT

This invention is designed to form thin films of metal sulfides usable in various types of electronic devices with a simple process comprising forming a layer of an organometallic compound having at least one metal-sulfur or metal-oxygen bond in the molecule on a substrate by printing or other means and then thermally decomposing the formed organometallic compound layer in an inert gas which may or may not be mixed with hydrogen sulfide.

4 Claims, 70 Drawing Sheets

PROCESS FOR FORMING THIN FILM OF METAL SULFIDES

TECHNICAL FIELD

This invention relates to a process for forming thin films of metal sulfides usable in various types of electronic devices.

BACKGROUND ART metal sulfides such as zinc sulfide, cadmium sulfide, lead sulfide, copper sulfide, etc., have been widely used in the field of electronics as a display material, photoconductor material, etc., in the form of thin films or crystals. Thin films of these compounds have been made mainly by using such techniques as vacuum deposition and sputtering.

Such conventional techniques, however, have the problems that since the operations are carried out in a vacuum vessel, they are poor in productivity, can not be easily adapted to a continuous process and require very costly production equipments. Also, the size of the products obtained is is limited to the size of the vacuum vessel used, so that it is difficult to obtain a film having a large surface area.

DISCLOSURE OF THE INVENTION

The purpose of the present invention is to eliminate the problems of conventional methods of forming thin films of compounds, and to this end the invention provides a process capable of forming thin films of metal sulfides in an effective and simple way.

The means for solving the problems according to the present invention comprises forming a layer of an organometallic compound having at lest one metalsulfur bond in the molecule on a substrate by printing or other methods and then thermally decomposing said organometallic compound layer in an inert gas mixed with hydrogen sulfide to thereby form a thin film of a metal sulfide.

The organometallic compounds having at least one metal-sulfur bond in the molecule which are usable in this invention include a variety of metal mercaptides and a variety of metal salts of various thiocarboxylic acids and dithiocarboxylic acids. The methods for the synthesis of these compounds are well known in the art.

The substrate used in this invention for forming thereon a layer of an organometallic compound can be optionally selected from those available in the art which can withstand the thermal decomposition temperature. Since the thermal decomposition temperature is usually around 350–450° C., uncostly glass plate can be safely used as said substrate.

Said organometallic compound can be made into a uniform solution by selecting a proper solvent. This solution is coated on the substrate by known printing or coating method, and after removing the solvent by drying, the layer of said organometallic compound is thermally decomposed in an inert gas atmosphere which includes hydrogen sulfide, thereby to form a thin film of the sulfide of said metal on the substrate.

The thus produced metal sulfide, although formed at a low temperature, has the same crystal structure as the one formed at a high temperature as described in the Examples given later.

On the other hand, a salient characteristic of the metal sulfides according to the present invention is the fact that the thin film formed for such metal sulfide is an aggregate of fine particles of the compound unlike the thin films formed by the conventional methods such as vacuum deposition.

The diameter of said fine particles is subject to change according to the various conditions under which the thermal decomposition is carried out, but the result of observation by a high-resolution electron microscope showed that it was from 100 to several thousands of angstroms in an instance.

By using said means of the present invention, it is possible to form thin films of metal sulfides without using a vacuum vessel which has been a drawback to the conventional methods. Thus, the present invention can realize an improvement of productivity in the manufacture of thin films and also enables easy formation of thin films having a large area.

BEST MODE FOR CARRYING OUT THE INVENTION

The present invention will be further described hereinbelow by way of the embodiments thereof.

EXAMPLE 1

Zinc laurylmercaptide obtained by reacting lauryl mercaptan with zinc acetate in a water/alcohol solvent was dissolved in a hydrocarbon solvent and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film of 1,000–5,000 Å thickness was formed on the glass plate. Examination of this thin film by X-ray diffraction showed that it was composed of zinc sulfide of hexagonal system.

EXAMPLE 2

Lead laurylmercaptide was dissolved in a hydrocarbon solvent and the solution was spin-coated on a glass plate.

The coated glass plate was predried at about 150° C. to remove the solvent and then fired at 550° C. for one hour in a nitrogen gas stream containing 2–10% by volume of hydrogen sulfide.

On the glass plate was formed a substantially transparent thin film of 1,000–5,000 Å thickness. X-ray diffraction pattern of this film showed that it was composed of lead sulfide.

EXAMPLE 3

Cadmium mercaptide was dissolved in a hydrocarbon solvent and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film of 1,000–5,000 Å thickness was formed on the glass plate. This film was confirmed to be composed of cadmium sulfide by X-ray diffraction.

EXAMPLE 4

Zinc thiobenzoate was dissolved in a hydrocarbon solvent and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film was formed on the glass plate. Examination of this film by X-ray diffraction confirmed that it was composed of zinc sulfide.

EXAMPLE 5

Zinc cymlcarbithionate was dissolved in a hydrocarbon solvent and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film was formed on the glass plate. X-ray diffraction analysis confirmed that the film was composed of zinc sulfide.

EXAMPLE 6

Zinc laurylalkoxide obtained from sodium laurylalkoxide and zinc acetate was dissolved in alcohol and the solution was spin-coated on a glass plate.

the coated glass plate was predired at about 150° C. to remove the solvent and then fired at 550° C. for one hour in a nitrogen gas stream containing 2–10% by volume of hydrogen sulfide.

The treatment gas a substantially transparent thin film of 1,000–5,000 Å thickness on the glass plate. X-ray diffraction analysis of the film confirmed that the film was composed of zinc sulfide of hexagonal system.

EXAMPLE 7

Lead laurylalkoxide obtained from sodium laurylalkoxide and lead acetate was dissolved in an alcohol solvent and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film of 1,000–5,000 Å thickness was formed on the glass plate. The film was identified as lead sulfide by X-ray diffraction.

EXAMPLE 8

Cadmium laurylalkoxide obtained from lauryl alcohol and cadmium acetate was dissolved in alcohol and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film was formed on the glass plate. X-ray diffraction analysis confirmed that the film was composed of cadmium sulfide.

EXAMPLE 9

Zinc 2-ethylhexanoate was dissolved in alcohol and the solution was spin-coated on a glass plate.

The coated glass plate was predried at about 150° C. to remove the solvent and then fired at 550° C. for one hour in a nitrogen gas stream containing 2–10% by volume of hydrogen sulfide.

On the glass plate was formed a substantially transparent thin film of 1,000–5,000 Å thickness. Examination of this film by X-ray diffraction confirmed that it was composed of zinc sulfide of hexagonal system.

EXAMPLE 10

Zinc acetyl acetate was dissolved in alcohol and the solution was spin-coated on a glass plate.

The coated glass plate was predried at about 150° C. to remove the solvent and then fired at 550° C. for one hour in a nitrogen gas stream containing 2–10% by volume of hydrogen sulfide.

A substantially transparent thin film of 1,000–1,500 Å thickness was formed on the glass plate. Analysis by X-ray diffraction confirmed that the material composing the film was zinc sulfide of hexagonal system.

EXAMPLE 11

Zinc laurylbenzenesulfonate obtained from sodium laurylbenzenesulfonate and zinc acetate was dissolved in a hydrocarbon solvent and the solution was spin-coated on a glass plate.

The coated glass plate was predried at about 150° C. to remove the solvent and the fired at 550° C. for one hour in a nitrogen gas stream containing 2–10% by volume of hydrogen sulfide.

A substantially transparent thin film of 1,000–5,000 Å thickness was formed on the glass plate. X-ray diffraction analysis of the film confirmed that the film material was zinc sulfide.

INDUSTRIAL APPLICABILITY

As seen from the embodiments described above, the procsss according to the present invention, as compared with the conventional film-forming methods by vacuum deposition or sputtering, has very industrially beneficial features that it is excellent in productivity, requires no excessively costly production equipments and enables easy formation of thin films having a large area.

Further, the process according to the present invention is effective in that it allows crystallization and film-forming of the material at low temperatures and in the case of zinc sulfide for instance, the conventional methods require a fired temperature above 1,000° C. for producing a film of zinc sulfide of $\alpha$-type hexagonal system, but according to the process of this invention such film can be obtained at a temperature of around 500° C.

What is claimed is:

1. A process for forming a thin film of a metal sulfide, which comprises coating a substrate with a layer of a solution including an organometallic compound having at least one metal-sulfur bond in the molecule, and then thermally decomposing said organometallic compound layer in an inert gas mixed with hydrogen sulfide to form a thin film of a metal sulfide.

2. The process according to claim 1, wherein the organometallic compound having at least one metal-sulfur bond is a metal mercaptide.

3. The process according to claim 1, wherein the organometallic compound having at least one metal-sulfur bond is a thiocarboxylate of a metal.

4. The process according to claim 1, wherein the organometallic compound having at least one metalsulfur bond is a dithiocarboxylate of a metal.

* * * * *